US006601723B1

(12) United States Patent
Ziglar

(10) Patent No.: US 6,601,723 B1
(45) Date of Patent: Aug. 5, 2003

(54) METHOD AND SYSTEM FOR PROVIDING AN EASILY ASSEMBLED RIGID-WALLED WICKER HAMPER

(75) Inventor: Paul S. Ziglar, Burlington, IA (US)

(73) Assignee: Lamont Limited, Burlington, IA (US)

( * ) Notice: Subject to any disclaimer, the term of this patent is extended or adjusted under 35 U.S.C. 154(b) by 0 days.

(21) Appl. No.: 10/063,500

(22) Filed: Apr. 30, 2002

(51) Int. Cl.[7] ..... B65D 8/14

(52) U.S. Cl. ..... 220/4.34; 220/6; 220/7; 220/4.28; 312/258

(58) Field of Search ..... 220/9.1, 9.2, 9.3, 220/4.34, 6, 7, 4.29, 4.33, 4.28; 312/258, 265.1, 262, 265.2, 265.3, 259; 5/99.1; 160/136, 135; 217/16, 48

(56) References Cited

U.S. PATENT DOCUMENTS

| | | | | | |
|---|---|---|---|---|---|
| 579,030 | A | * | 3/1897 | Yerby | 248/188.4 |
| 1,595,929 | A | * | 8/1926 | Rhodes | 160/135 |
| 1,692,765 | A | | 11/1928 | Salt | |
| 2,348,012 | A | * | 5/1944 | Levi | 256/25 |
| 2,476,366 | A | * | 7/1949 | Grim | 220/4.33 |
| 2,841,306 | A | * | 7/1958 | Vitoux | 220/7 |
| 2,919,045 | A | | 12/1959 | Waugh et al. | |
| 3,246,828 | A | * | 4/1966 | Branscum et al. | 220/4.34 |
| 3,404,818 | A | * | 10/1968 | Miscoe | 224/42.34 |
| 3,405,835 | A | | 10/1968 | Eby | |
| 3,451,578 | A | | 6/1969 | Edmundson | |
| 3,565,377 | A | * | 2/1971 | Schreyer | 248/188.4 |
| 3,727,786 | A | * | 4/1973 | Fausel | 217/16 |
| 3,759,412 | A | * | 9/1973 | Bush | 220/7 |
| 4,020,604 | A | | 5/1977 | Legler et al. | |
| 4,169,639 | A | | 10/1979 | Zola | |
| 4,463,864 | A | | 8/1984 | Roach | |
| 4,789,075 | A | | 12/1988 | Sun | |
| 5,054,635 | A | | 10/1991 | Kolom | |
| 5,107,652 | A | * | 4/1992 | Sosa | 52/578 |
| 5,163,417 | A | | 11/1992 | Dalton | |
| 5,359,809 | A | | 11/1994 | Johnson | |
| 5,464,113 | A | * | 11/1995 | Ho et al. | 220/9.2 |
| 5,490,604 | A | | 2/1996 | Alexander | |
| 5,931,326 | A | * | 8/1999 | Weng | 206/512 |
| 5,964,533 | A | | 10/1999 | Ziglar | |
| 5,971,187 | A | | 10/1999 | Clee et al. | |
| 6,006,918 | A | | 12/1999 | Hart | |
| 6,019,226 | A | | 2/2000 | Zajdlik et al. | |
| 6,089,394 | A | | 7/2000 | Ziglar | |
| 6,216,872 | B1 | | 4/2001 | Haasbroek | |
| 6,216,899 | B1 | | 4/2001 | Vicari | |
| 6,230,915 | B1 | * | 5/2001 | Liu | 220/6 |
| 6,299,011 | B1 | | 10/2001 | Rosenfeldt | |

OTHER PUBLICATIONS

Copies of Webpages from Target.com showing photos of hampers—2 pages.

Copy of Webpage of Pier 1 Imports showing Ventura Hamper.

Copy of photo of hamper made by BBI Corporation, Angeles City, Philippines.

* cited by examiner

*Primary Examiner*—Lee Young
*Assistant Examiner*—Joseph C. Merek
(74) *Attorney, Agent, or Firm*—Simmons, Perrine, Albright & Ellwood, P.L.C.

(57) ABSTRACT

A system and method for providing a multi-paneled hamper where adjacent panels are coupled to one another via an exposed hinge-like pivoting coupling.

14 Claims, 4 Drawing Sheets

METHOD AND SYSTEM FOR PROVIDING AN EASILY ASSEMBLED RIGID-WALLED WICKER HAMPER

BACKGROUND OF THE INVENTION

In recent years, more and more home furnishing items are being manufactured in Asia or other places that have labor costs relatively lower than those in the United States. For many small items, the foreign manufacture of products raises few logistical problems. However, with furniture and home furnishings, the size of the item can make a tremendous difference in the ability to sell the product. For example, cost of shipping a fully assembled rigid sided hamper can be prohibitive. The term "hamper" is defined to include a container sized and configured for retaining laundry. The term "hamper" is defined to include a container having a volumetric range from 2.0 cubic feet to 6.0 cubic feet. The term "hamper" is intended to refer only to containers which have a lid which can be raised to insert clothing therein. In the alternative, the term "hamper" is intended to include a tilting apparatus where a lid portion is stationary, and a front, back or side portion is arranged to be tilted away from the lid section so as to expose an area where laundry can be inserted. "Hamper" is also intended to specifically exclude baskets or other containers which are designed with pivoting or flexible handles which are configured to be disposed above a concave section for carrying items.

Additionally, shipping fully assembled hampers reduces the number of items that a retailer can maintain in stock for a given shelf space. This can affect the ability for a seller to supply hampers, especially during times when the demands fluctuate.

Other hampers exist which have spring wire therein which provides for an easily deployable hamper. One example of this approach is described in U.S. Pat. No. 5,964,533. Another example of a folding or collapsible hamper is described in U.S. Pat. No. 6,089,394, both of which were issued to Paul S. Ziglar. These patents are hereby incorporated herein in their entirety by these references.

While these hampers have been used extensively in the past, they do have some drawbacks. First of all, some consumers prefer a more rigid hamper than that which is provided by the spring wire hampers. The '394 patent describes a hamper which is more complex to build than would be necessary with the present invention.

Consequently, there exists a need for improved methods and systems for providing an easily assembled exterior framed hamper.

SUMMARY OF THE INVENTION

It is an object of the present invention to provide a system and method for providing an easily assembled rigid-walled hamper.

It is a feature of the present invention to utilize a set of hinge-like connectors between adjoining panels.

It is another feature of the present invention to have a pivoting bottom section coupled to at least one panel.

It is another feature of the present invention to include screw-on feet.

It is another advantage of the present invention to achieve improved efficiency in assembling a hamper.

The present invention is an apparatus and method for providing an easily assembled hamper designed to satisfy the aforementioned needs, provide the previously stated objects, include the above-listed features, and achieve the already articulated advantages. The present invention is carried out in a "wasted time-less" manner, in a sense that the time required by a consumer to assemble a hamper, has been greatly reduced.

Accordingly, the present invention is a system and method including an external framed hamper having hinge-like panel couplings.

BRIEF DESCRIPTION OF DRAWINGS

The invention may be more fully understood by reading the following description of the preferred embodiments of the invention, in conjunction with the appended drawings wherein.

DETAILED DESCRIPTION

Figure 1:
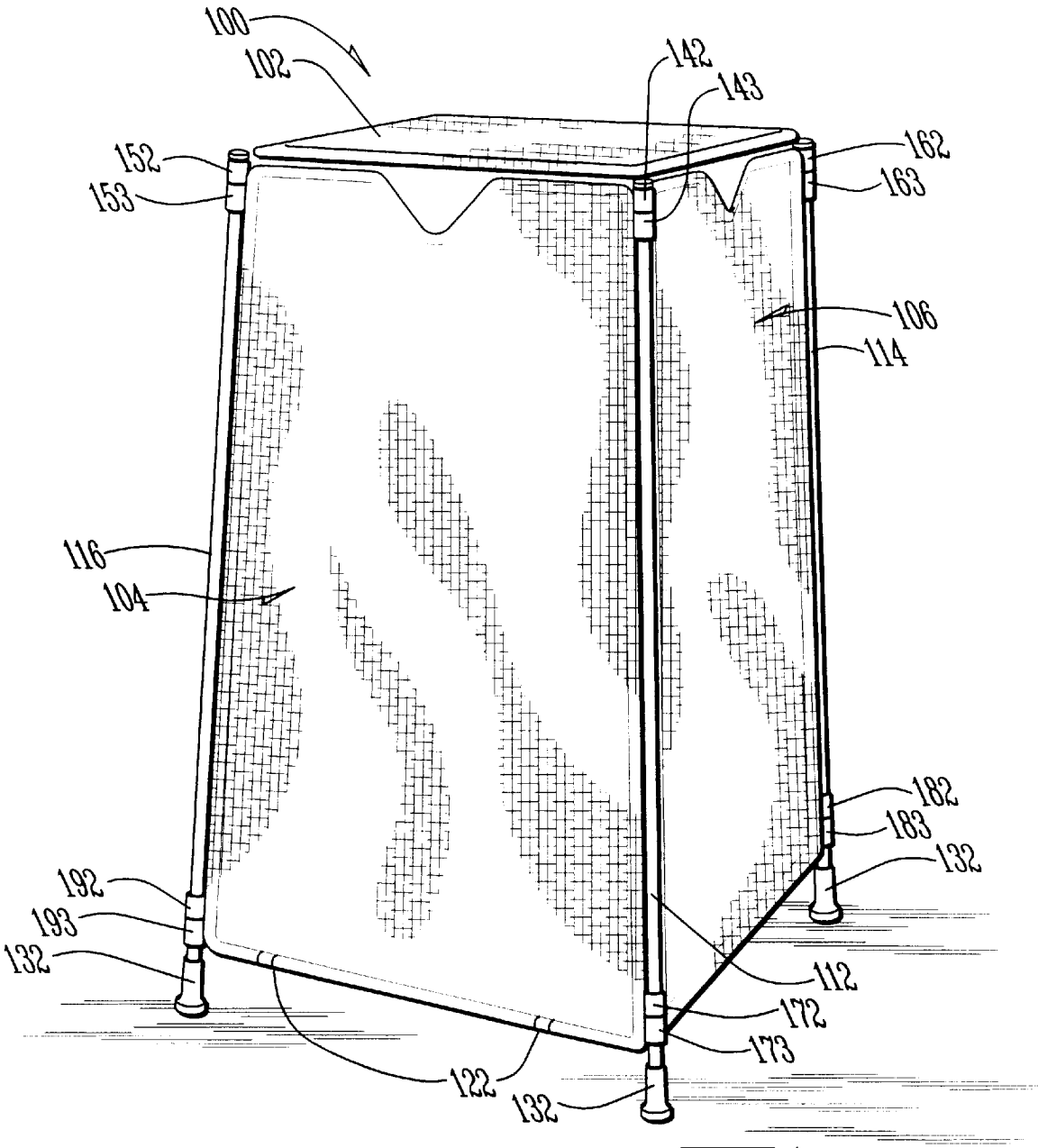
FIG. 1 is a perspective view of a hamper of the present invention.

Now referring to the drawings wherein like numerals refer to the like matter throughout, and more specifically referring to FIG. 1, there is shown a system of the present invention generally designated 100, including a pivotable hinged hamper top 102. Also shown are front hamper panel 104 and right hamper panel 106. The panel material is preferably wicker, which is intended to be made of the following twig materials: rattan, bamboo, abacca, willow (both full and split), seagrass, rattan core and pell, palm leaf, twisted rope, fern, water hyacinth, and folded and/or twisted paper or plastic, The term "wicker" as used herein is intended to specifically exclude the following materials: cotton, wool, textiles and rubber. However, it should be understood that the panel material could in alternate embodiments be made of fabric, textiles or any suitable material, which may be rigid, semi-rigid, and/or non-rigid. Also shown are right front exposed hamper hinge pin leg 112, right rear exposed hamper hinge pin leg 114 and left front exposed hamper hinge pin leg 116. These legs may be metal, wood, plastic or any suitable material. They may be painted, unpainted or otherwise.

Figure 2:
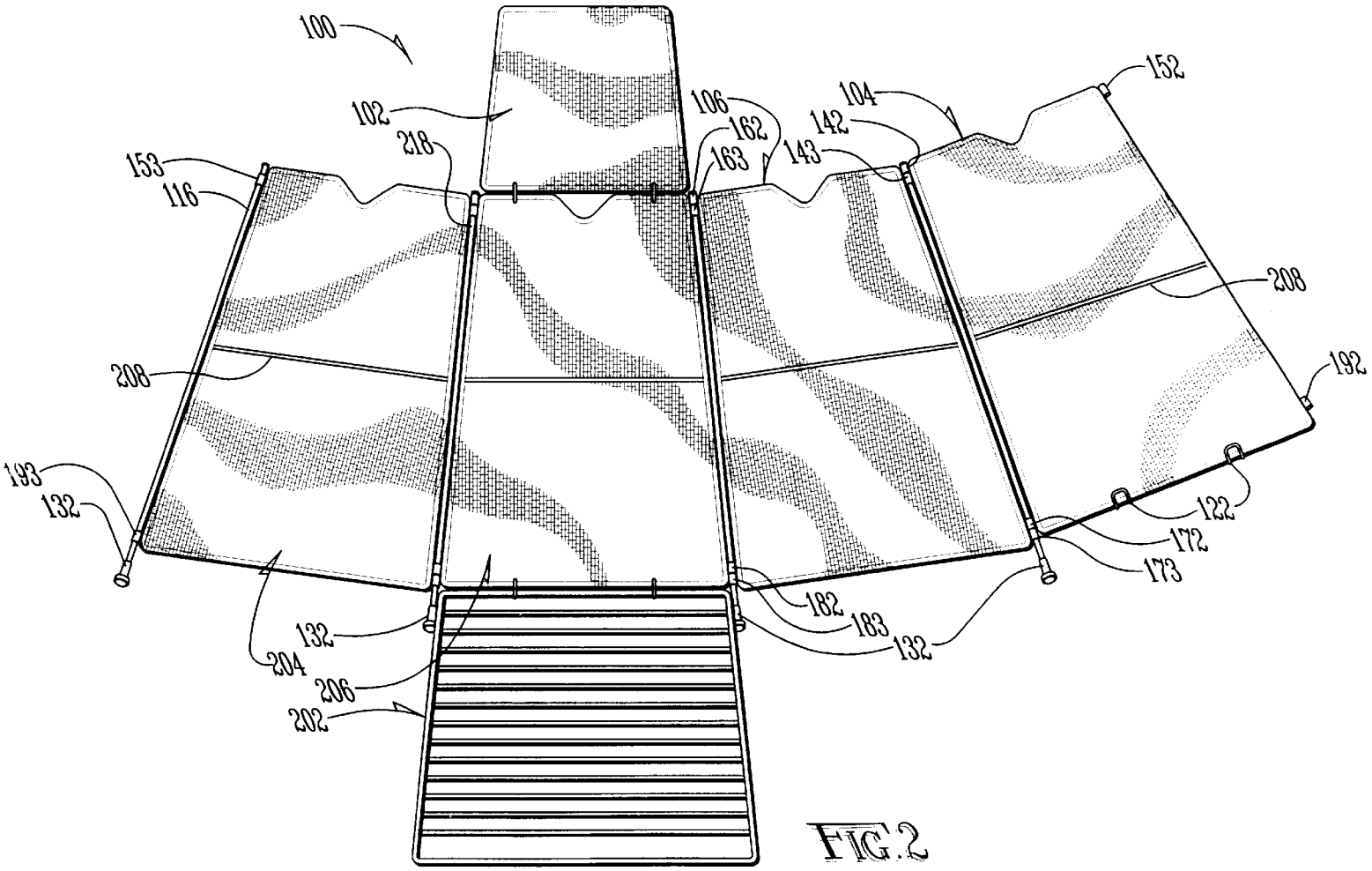
FIG. 2 is a perspective view of a partially assembled hamper of the present invention.

Also shown are front side hinged bottom panel supports 122, which help support the folding bottom metal grate 202 (FIG. 2). Right front exposed hamper hinge pin leg 112, right rear exposed hamper hinge pin leg 114 and left front exposed hamper hinge pin leg 116, as well as left rear exposed hamper hinge pin leg 218 (FIG. 2) are coupled to front hamper panel 104, right hamper panel 106, left hamper panel 204 (FIG. 2) and back hamper panel 206 (FIG. 2) with a hinge-like arrangement. Each pair of adjacent panels is coupled by a single hinge pin and a top and bottom pair of knuckles.

More specifically, there is shown front-right top knuckle 142, and front-right top bottom knuckle 143, which like front-right bottom top knuckle 172 and front-right bottom bottom knuckle 173, are joined by right front exposed hamper hinge pin leg 112. Similarly, back-right top top knuckle 162 and back-right top bottom knuckle 162, as well as back-right bottom top knuckle 182 and back-right bottom bottom knuckle 182 are joined by right rear exposed hamper hinge pin leg 114. Front-left top top knuckle 152 and front-left top bottom knuckle 152, together with front-left bottom top knuckle 192 and front-left bottom bottom knuckle 193, are linked by left front exposed hamper hinge pin leg 116.

A more detailed understanding of the present invention can be achieved by now referring to FIG. 2, which shows the hamper 100 at an intermediate step during the assembly process. All of the panels have been connected to one another except that left hamper panel 204 is yet unconnected to front hamper panel 104, due to the omission of left front exposed hamper hinge pin leg 116. This partially assembled view provides a view of folding bottom metal grate 202, back hamper panel 206 and several of the hamper panel mid-section supports 208.

Figure 3:
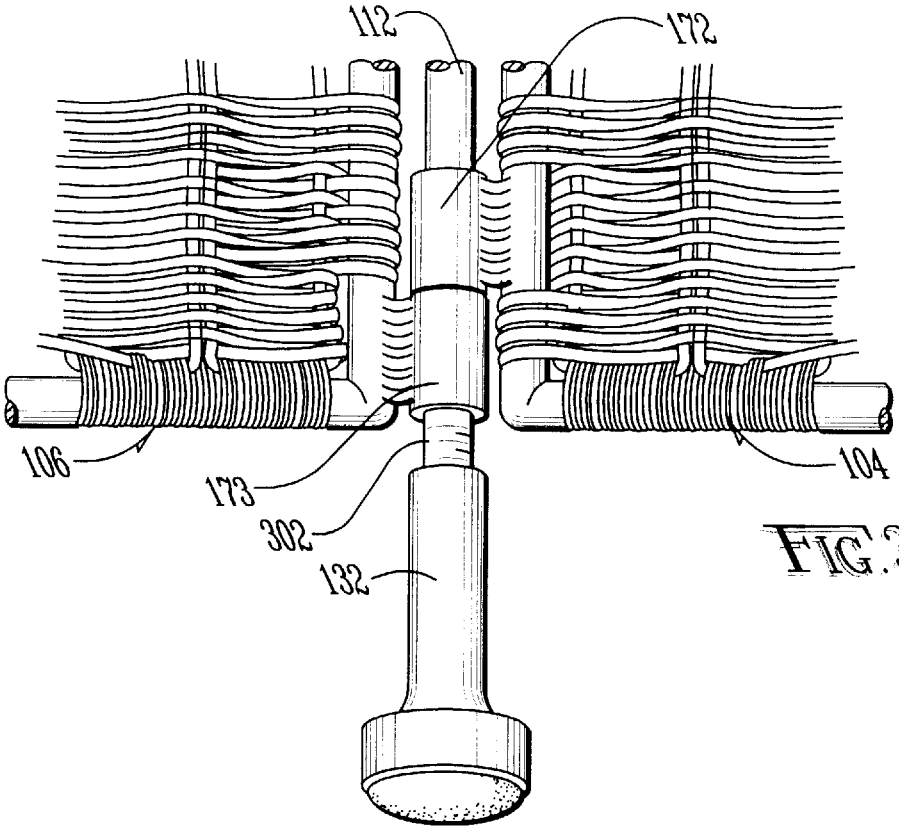
FIG. 3 is a perspective view of a lower section of the connection between the front panel and the side panel.

An even more detailed understanding of the present invention may be achieved by now referring to FIG. 3, which shows a close up view of front-right bottom top knuckle 172 and front-right bottom bottom knuckle 173. Screw-on feet 132 are shown partially threaded onto the threaded leg end 302 of right front exposed hamper hinge pin leg 112.

Figure 4:
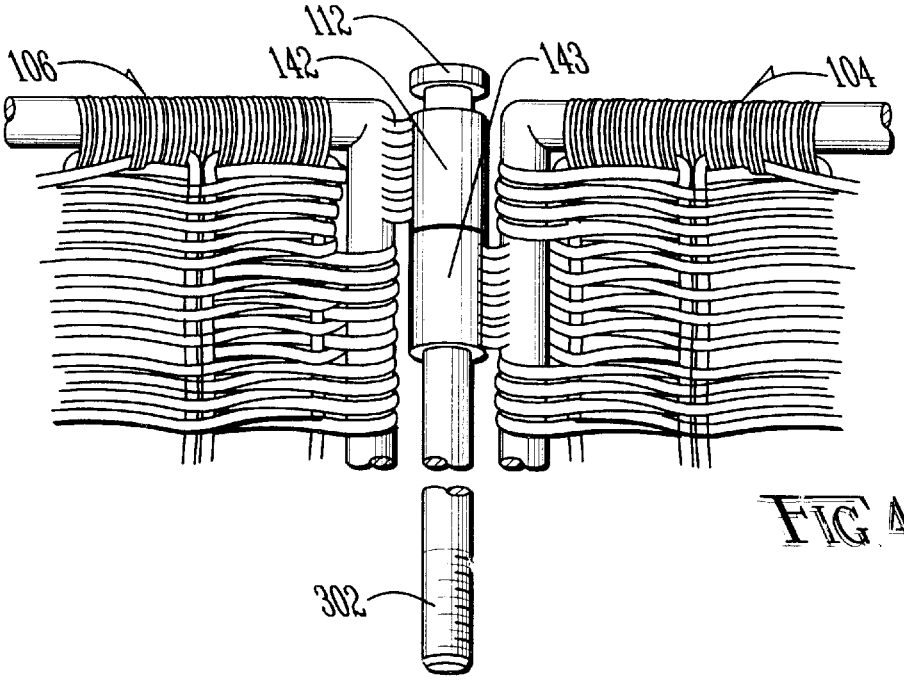
FIG. 4 is a perspective view of the upper section of the connection between the front panel and the side panel shown in FIG. 3.

Now referring to FIG. 4, there is shown a close-up view of front-right top top knuckle 142 and front-right top bottom knuckle 143. It can be seen that front-right top bottom knuckle 143 is part of front hamper panel 104, while front-right top top knuckle 142 is part of right hamper panel 106.

Figure 5:
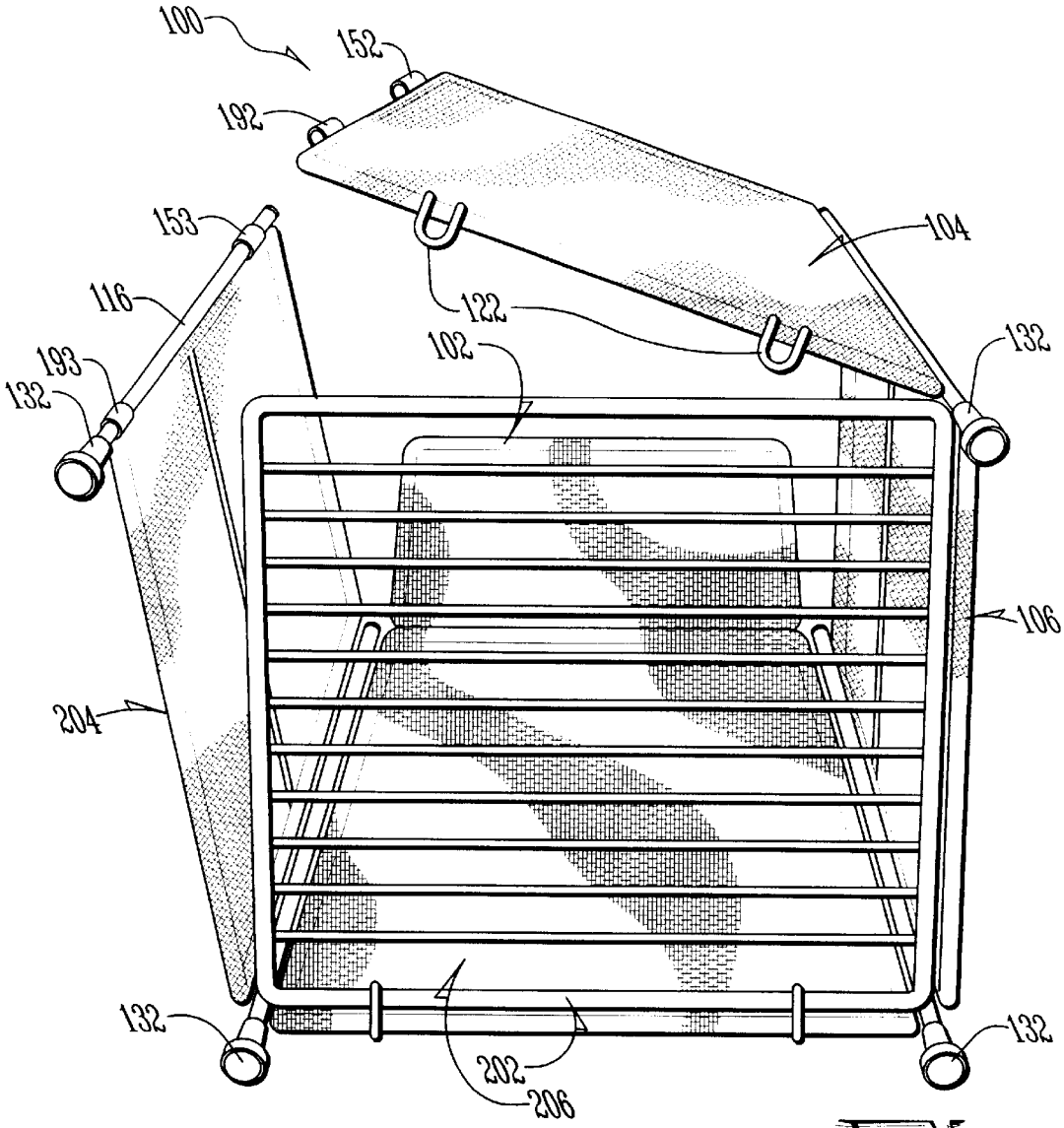
FIG. 5 is a perspective view of the underside of the hamper of the present invention as it is being assembled.

Now referring to FIG. 5, there is shown a bottom-up view of the hamper 100 during the process of assembly where left hamper panel 204 is being attached to front hamper panel 104 via alignment of the appropriate knuckles and the insertion of left front exposed hamper hinge pin leg 116. Pivotable hinged hamper top 102 is shown in an open position.

In operation, the apparatus and method of the present invention as described in FIGS. 1–5, could be assembled as follows:

Pivotable hinged hamper top 102, folding bottom metal grate 202 and back hamper panel 206 are pre-assembled before shipment to the retail outlet or the consumer. Right hamper panel 106 and left hamper panel 204 are coupled to back hamper panel 206 by insertion of left rear exposed hamper hinge pin leg 218 and right rear exposed hamper hinge pin leg 114 respectively. Front hamper panel 104 is them coupled to right hamper panel 106 by insertion of right front exposed hamper hinge pin leg 112. Finally, left hamper panel 204 and front hamper panel 104 are coupled by insertion of left front exposed hamper hinge pin leg 116. Screw-on feet 132 may be added immediately after insertion of each leg or done after all legs have been inserted.

Screw-on feet 132, when screwed on tightly, can crate pressure on the knuckles by pressing the knuckles against a flat head section of the hinge pins.

Throughout this description, reference is made to a hamper, because it is believed that the beneficial aspects of the present invention would be most readily apparent with hampers; however, it should be understood that the present invention is not intended to be limited to hampers, and other household containers could be made as well. Also, throughout this description, reference has been frequently made to wicker hampers, wicker panels and wicker in general. It should be understood that the present invention could be of a non-wicker construction. In fact, the panels of the present invention could be textiles, sheets of plastic, wood or any other suitable material. Additionally, it should be understood that the pins used to connect the knuckles may, in some alternate embodiments, be unexposed. It should also be understood that while a trapezoidal shape may be preferred in some situations, the present invention is not intended to be limited to trapezoidal shapes. The present invention is intended to also be applicable to non-wicker, rectangular containers which have unexposed pins and folding handles.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. A method of assembling a hamper comprising the steps of:

providing a hamper back with a bottom pivotally coupled thereto;

providing a first panel, a second panel and a wicker front panel;

providing each side of each of said hamper back, said first panel, said second panel and said wicker front panel with a top hinge knuckle and a bottom hinge knuckle;

coupling each one of said hamper back said first panel, said second panel and said wicker front panel to another of said hamper back, said first panel, said second panel, and said wicker front panel, by pushing one of four separate rods through a top pair of hinge knuckles and a bottom pair of hinge knuckles;

wherein each of said top pair of hinge knuckles and said bottom pair of hinge knuckles is formed by a knuckle on one of said panels and a knuckle on another adjoining panel;

wherein a substantial portion of each of said four separate rods is exposed between said top pair of hinge knuckles and said bottom pair of hinge knuckles; and wherein each of said first panel, said second panel, said hamper back and said wicker front panel have disposed thereon an equal number of hinge knuckles.

2. A method of claim 1 further comprising the step of:

screwing a detachable foot onto a threaded portion of each of said four separate rods.

3. A method of claim 2 further comprising the step of:

folding said front panel, said second panel and said wicker front panel from a flat orientation to an obelisk configuration when taken together with said hamper back.

4. A method of claim 1 further comprising the step of folding said first panel, said second panel and said wicker front panel from a flat orientation to a three-dimensional closed configuration when taken together with said hamper back.

5. A method of claim 3 wherein said first panel, said second panel and said front panel are trapezoidal in shape.

6. A wicker hamper comprising:

a wicker back hamper panel, having a top side, a bottom side, a right side and a left side;

said wicker back hamper panel having a back hamper panel right side top hinge knuckle, a back hamper panel left side top hinge knuckle, a back hamper panel right side bottom hinge knuckle and a back hamper panel left side bottom hinge knuckle;

a wicker right panel, having a right panel right side top hinge knuckle, a right panel left side top hinge knuckle, a right panel right side bottom hinge knuckle and a right panel left side bottom hinge knuckle;

a wicker front panel, having a front panel right side top hinge knuckle, a front panel left side top hinge knuckle, a front panel right side bottom hinge knuckle and a front panel left side bottom hinge knuckle;

a wicker left panel, having a left panel right side top hinge knuckle, a left panel left side top hinge knuckle, a left panel right side bottom hinge knuckle and a left panel left side bottom hinge knuckle; and a bottom pivotally coupled to said wicker hamper back panel; and four pins, each of which is configured to pass through a pair of top hinge knuckles and a pair of bottom hinge knuckles where each of said pairs is formed by a knuckle on one of said panels and a knuckle on another adjoining panel;

wherein each of said four pins has a substantial exposed portion and wherein each of said wicker right pane, said wicker left panel, said wicker hamper back panel, and said wicker front panel have disposed thereon an equal number of hinge knuckles.

7. A hamper of claim 6 wherein each of said four pins has a detachable foot coupled thereto.

8. A hamper of claim 7 where said detachable foot is screwed onto a lower threaded portion of a pin.

9. A hamper of claim 8 wherein said each of said four pins is a partially exposed pin which has a middle section which is exposed and is longer than a total of all non-exposed sections thereof.

10. A hamper of claim 9 wherein a distance between said back hamper panel right side top hinge knuckle and said back hamper panel right side bottom hinge knuckle is greater than half of a distance between said top side and said bottom side.

11. A hamper of claim 10 wherein said bottom section comprises a folding bottom metal grate pivotally coupled to at least one of said back hamper panel, said right panel, said left panel and said front panel.

12. A hamper of claim 11 further comprising a top pivotally coupled to said back hamper panel.

13. A hamper of claim 12 wherein said back hamper panel is a trapezoidal shape.

14. A hamper of claim 13 wherein said right panel, said left panel and said front panel are each trapezoidal in shape, thereby creating a hamper having a truncated obelisk shape.

* * * * *

UNITED STATES PATENT AND TRADEMARK OFFICE

CERTIFICATE OF CORRECTION

PATENT NO. : 6,601,723 B1
DATED : August 5, 2003
INVENTOR(S) : Paul S. Ziglar

It is certified that error appears in the above-identified patent and that said Letters Patent is hereby corrected as shown below:

Column 2,
Line 32, please delete the word “the”.
Line 39, please delete “pell” and insert therefor -- peel --.
Line 63, please insert -- top -- between the words “top” and “knuckle”.

Column 3,
Line 1, please delete “162” and insert therefor -- 163 --.
Line 3, please delete “182” and insert therefor -- 183 --.
Line 5, please delete “152” and insert therefor -- 153 --.
Line 49, please delete “them” and insert therefor -- then --.
Line 55, please delete “crate” and insert therefor -- create --.

Column 4,
Line 29, please insert -- , -- after the word “back” and before the word “said”.
Line 49, please delete “front” and insert therefor -- first --.

Column 5,
Line 12, please insert a paragraph after the word “knuckle;”.
Line 12, please delete the word “and”.
Line 20, please delete “pane” and insert therefor -- panel --.

Signed and Sealed this

Twenty-third Day of December, 2003

JAMES E. ROGAN
*Director of the United States Patent and Trademark Office*